United States Patent [19]

Ohta

[11] 4,264,185

[45] Apr. 28, 1981

[54] TWO COLOR ELECTROSTATOGRAPHIC APPARATUS

[75] Inventor: Wasaburo Ohta, Tokyo, Japan

[73] Assignee: Ricoh Co., Ltd., Tokyo, Japan

[21] Appl. No.: 38,897

[22] Filed: May 14, 1979

[30] Foreign Application Priority Data

May 24, 1978 [JP] Japan ..... 53-61929

[51] Int. Cl.[3] ..... G03G 15/01

[52] U.S. Cl. ..... 355/4; 118/661; 355/3 DD; 355/10

[58] Field of Search ..... 355/3 R, 3 DD, 4, 10; 118/653, 656, 657, 658, 659, 661

[56] References Cited

U.S. PATENT DOCUMENTS

| | | | |
|---|---|---|---|
| 3,045,644 | 7/1962 | Schwertz | 355/4 X |
| 3,601,092 | 8/1971 | Satomi | 118/661 |
| 3,687,109 | 8/1972 | Egnaczak | 118/661 X |
| 3,702,483 | 11/1972 | Fantuzzo | 355/4 X |
| 4,189,224 | 2/1980 | Sakai | 355/4 |

*Primary Examiner*—Fred L. Braun
*Attorney, Agent, or Firm*—David G. Alexander

[57] ABSTRACT

An imaging unit forms a bipolar electrostatic image of a two color original document on a photoconductive drum (12). A first developing unit (13) applies a toner (16) of a first color and polarity to the drum (12) and a second developing unit (14) applies a toner (17) of a second color and polarity to the drum (12) to form a two color electrostatic image which is transferred and fixed to a copy sheet. A bias voltage of the first polarity is applied to the second developing unit (14) to repel the toner (16) of the first color and polarity against the drum (12) and prevent degradation of the first color toner image. A bias voltage of the second polarity is applied to the first developing unit (13) to prevent contamination of the first color toner (16) with the second color toner (17).

3 Claims, 4 Drawing Figures

TWO COLOR ELECTROSTATOGRAPHIC APPARATUS

BACKGROUND OF THE INVENTION

The present invention relates to a two color electrostatographic apparatus such as a copying machine, printer for a facsimile system or the like.

A novel and unique two color electrostatic copying machine is disclosed in copending United States patent application Ser. No. 912,273, filed June 5, 1978, entitled "COLOR ELECTROSTATOGRAPHIC PROCESS AND MATERIAL FOR PRACTICING SAME": which is assigned to the same assignee as this application. The present invention constitutes improvements to the basic copying machine which yet further increase the copy quality.

Color electrostatic copying machines which produce full color copies are known in the art. These are generally of two types. The first type comprises a single photoconductive drum or belt which is exposed to a light image of an original document three times through filters of three primary colors respectively. After each imaging operation, a toner substance of a corresponding color is applied to the drum to form a color toner image which is transferred to a copy sheet. In this manner, three color toner images are sequentially formed on the drum and transferred to the copy sheet in register to produce a color copy. Often, a fourth black toner image is formed and transferred to the copy sheet in register with the three color toner images.

In such a copying machine it is essential that the toner images be transferred to the copy sheet is perfect register. The control mechanism for such a copying machine is therefore intricate and expensive. The three or four imaging operations for each copy require a disproportionate amount of time, making the process very slow.

The second type of color copying machine is much faster in operation but also much more expensive to manufacture. Such a copying machine comprises three or four photoconductive drums or belts. The original document is passed over all of the drums in one scanning movement, sequentially imaging the drums through three respective primary color filters. A toner development unit is associated with each drum. The copy sheet is fed through the machine in one pass, with the toner images being transferred thereto in register through sequential engagement with the drums.

In addition to the increased cost of the three or four drums compared to only one drum or belt in the first type of color copying machine, an intricate mechanism is also required in the second type of copying machine to ensure perfect register of the three of four toner images on the copy sheet.

A full color copying machine is unnecessary in many business operations where only commercial documents are copied, since such documents generally only comprise the colors black and red, in addition to a white background. This is because accounting records and the like generally contain credit entries in black and debit entries in red. Since in many such documents the debit and credit entries may be distinguished from each other only by the color of ink, many offices have purchased or leased full color copying machines for copying such records. The full color copying capability is wasted since it is only necessary to distinguish red from black on the copies.

The electrostatic copying machine disclosed in the above mentioned copending patent application utilizes only a single drum on which are formed at least two photoconductive layers having different spectral sensitivities. The drum is charged at least twice with different polarities and exposed to a light image of an original document bearing at least two colors such as black and red on a white background. The photoconductive layers conduct in different ways to form a bipolar electrostatic image. For example, red image areas may have a positive polarity, black image areas may have a negative polarity and white areas will have no charge. The electrostatic image is developed by means of negatively charged red toner particles which adhere to the positive red electrostatic image areas and positively charged black toner particles which adhere to the negative black image areas. The resulting two color toner image is transferred and fixed to a copy sheet to provide a finished reproduction of the original document.

The toner particles may be mixed together and applied to the drum in a single step. However, it has been found that better image quality is obtainable by applying the toners to the drum separately. For example, a first developing unit will apply the red toner to the drum and then a second developing unit will apply the black toner to the drum.

A problem has remained heretofore unsolved in that the toner image formed in the first developing step is degraded in the second developing step. In some cases the first toner comes off the drum in the second developing step, thereby producing a toner image of insufficient density. The first toner mixes with the second toner to contaminate the second toner. Where the second developing unit must be disposed above the first developing unit to accommodate the overall layout of the copying machine, the second toner has a tendency to drop down from an unavoidable small gap between the second developing unit and the drum into the first developing unit to contaminate the first toner. It will be understood that the two toners are charged to opposite polarities and are electrostatically attracted to each other. Combination of the two toners produces an electrostatically neutral substance which is incapable of producing a toner image. It has also been found that toner image degradation occuring in the second developing unit produces toner images with blurred edges and mixed colors.

SUMMARY OF THE INVENTION

An electrostatographic apparatus embodying the present invention includes a photoconductive member, imaging means for forming a bipolar electrostatic image on the photoconductive member, a first developing means for applying toner of a first color and polarity to the photoconductive member and a second developing means for subsequently applying a toner of a second color and polarity to the photoconductive member. Bias voltage means apply a bias voltage to at least one of the first and second developing means having a polarity opposite to the polarity of the toner which the respective first and second developing means applies to the photoconductive member.

In accordance with the present invention, an imaging means forms a bipolar electrostatic image of a two color original document on a photoconductive drum. A first developing unit applies a toner of a first color and polarity to the drum and a second developing unit applies a toner of a second color and polarity to the drum to form a two color electrostatic image which is transferred and fixed to a copy sheet. A bias voltage of the first polarity is applied to the second developing unit to repel the toner of the first color and polarity against the drum and prevent degradation of the first color toner image. A bias voltage of the second polarity is applied to the first developing unit to prevent contamination of the first color toner with the second color toner. It is an object of the present invention to provide a two color electrostatic copying machine which overcomes the problems of the prior art and produces two color copies of improved quality.

It is another object of the present invention to provide a two color electrostatographic apparatus which utilizes a unique biasing arrangement to prevent degradation of a first toner image in a second developing step.

It is another object of the present invention to provide a two color electrostatographic apparatus which utilizes a unique biasing arrangement to prevent contamination of a first toner with a second toner when a second developing unit is disposed above a first developing unit.

It is another object of the present invention to provide a generally improved two color electrostatographic apparatus.

Other objects, together with the foregoing, are attained in the embodiments described in the following description and illustrated in the accompanying drawing.

DESCRIPTION OF THE PREFERRED EMBODIMENTS

While the two color electrostatographic apparatus of the present invention is susceptible of numerous physical embodiments, depending upon the environment and requirements of use, substantial numbers of the herein shown and described embodiments have been made, tested and used, and all have performed in an eminently satisfactory manner.

Figure 1:
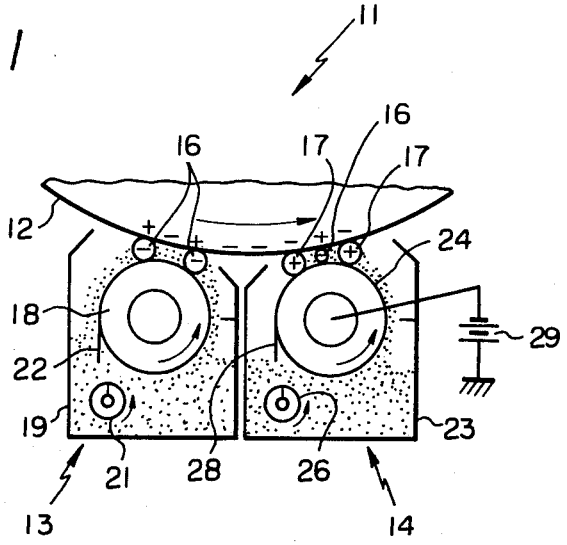
FIG. 1 is a schematic diagram of a first two color electrostatographic apparatus embodying the present invention.

Referring now to FIG. 1 of the drawing, an electrostatic copying apparatus or machine embodying the present invention is generally designated by the reference numerall 11 and comprises a photoconductive drum 12 which is rotated counterclockwise at constant speed. Although not shown, the drum 12 is formed with at least two photoconductive layers of different spectral sensitivities. For example, one layer may be panchromatic whereas the other layer is orthochromatic (insensitive to red light). The drum is charged at least twice with opposite polarities to produce a stratified charge pattern. The drum 12 is then radiated with a light image of an original document having at least black and red image areas to form a bipolar electrostatic image. The means for forming the bipolar electrostatic image is not the particular subject matter of the present invention and may be constituted by the arrangement disclosed in the above mentioned United States patent application which is incorporated herein by reference.

It will be assumed that the electrostatic image areas on the drum 12 corresponding to red image areas have a positive polarity whereas black image areas have a negative polarity. White or background image areas have no charge.

The apparatus 11 comprises a first developing unit 13 for producing a red toner image and a second developing unit 14 for producing a black toner image. The developing unit 13 applies negatively charged red toner particles to the drum 12 which adhere to the positive electrostatic image areas. This produces a red toner image. The developing unit 14 applies black toner particles to the drum 12 which adhere to the negative electrostatic image areas to produce a black toner image. It will be understood that after the operation performed by the developing unit 14, the drum 12 carries a two color toner image with red and black areas. This two color toner image is transferred and fixed to a copy sheet to produce a permanent reproduction of the original document. For purposes of explanation, the negatively charged red toner particles and the positively charged black toner particles are shown in exaggerated size and designated as 16 and 17 respectively. The toner particles 16 and 17 may be provided in one component form or mixed with carrier particles in two component form. The carrier particles may be magnetic or nonmagnetic. The toner particles are preferably made of colored resin or glass.

The developing unit 13 comprises a magnetic brush 18 which is rotated counterclockwise at constant speed inside a developing tank 19 which contains the toner particles 16. Assuming the case of a two component toner, an impeller 21 feeds the toner 16 and carrier particles to the magnetic brush 18 which conveys them to the drum 12. The toner particles 16 adhere to the positive electrostatic image areas on the drum 12 whereas the carrier particles (not shown) are scraped off the brush 18 by a scraper 22 along with unused toner particles 16 for recycling.

The developing unit 14 comprises a developing tank 23, magnetic brush 24, impeller 26 and scraper 28 which perform the same functions as the corresponding elements in the developing unit 13.

In accordance with an important feature of the present invention, the apparatus 11 further comprises a bias voltage source 29 which applies a negative bias voltage to the magnetic brush 24. It will be noted that the polarity of the bias voltage has the same polarity as the black electrostatic image areas on the drum 12 and a polarity opposite to that of the toner particles 17. However, the most important fact is that the polarity of the bias voltage applied by the source 29 has the same polarity as the toner particles 16 which are applied to the drum 12 by the developing unit 13 to form the red toner image. The bias voltage on the magnetic brush 24 repels the red toner particles 16 against the drum 12 and positively prevents them from coming off the drum 12 in the second developing unit 14. This prevents loss of density of the red toner image, contamination of the black toner particles 17 in the tank 23 and other undesirable phenomenon described in the background of the invention. The magnitude of the bias voltage is selected to be lower than the potential of the black areas of the electrostatic image on the drum 12.

Figure 2:
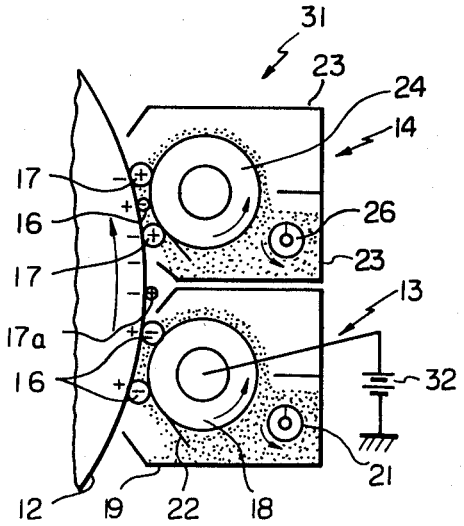
FIG. 2 is a schematic diagram of a second two color electrostatographic apparatus embodying the present invention.

FIG. 2 illustrates another electrostatic copying machine or apparatus embodying the present invention which is generally designated as 31. Like elements are designated by the same reference numerals used in FIG. 1. Whereas the developing units 13 and 14 are mounted horizontally in the apparatus 11, they are mounted vertically in the apparatus 31. It is important to note that the second developing unit 14 is mounted above the first developing unit 13.

The problem in this arrangement is that there must be a small gap provided between the developing unit 14 and the drum 12, and that a non-negligible amount of toner particles 17 drop from this gap into the developing unit 13 to contaminate the toner particles 16. Reference numeral 17*a* designates a toner particle 17 which is moving from the developing unit 14 toward the developing unit 13.

In the apparatus 31 the bias voltage source 29 is omitted. However, a bias voltage source 32 is provided which applies a positive bias voltage to the magnetic brush 18. This positive bias voltage has the same polarity as the toner particles 17 and has the effect of repelling the toner particles 17 and preventing the toner particles 17 from entering the developing unit 13. This arrangement positively prevents contamination of the toner particles 16 by toner particles 17 which are urged by gravity toward the developing unit 13. The toner particles 17 are repelled by the bias voltage on the magnetic brush 18 back into the developing unit 14. The magnitude of the bias voltage applied by the source 32 is selected to be lower than the electrostatic potential of the red areas of the electrostatic image.

Figure 3:
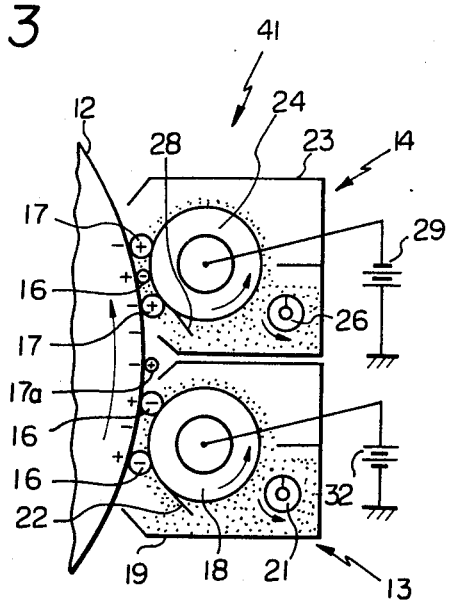
FIG. 3 is a schematic diagram of a third two color electrostatographic apparatus embodying the present invention.

FIG. 3 illustrates another electrostatic copying machine 41 which is a combination of the embodiments of FIGS. 1 and 2. The developing units 13 and 14 are disposed vertically as in the copying machine 31. However, the copying machine 41 further comprises the bias voltage source 29 of the copying machine 11. The bias voltage sources 29 and 32 produce the same effects described above. As an additional advantage, it will be noted that the bias voltage applied by the sources 29 and 32 are opposite in polarity to the toner particles 17 and 16 and aid in attracting them to the magnetic brushes 24 and 18 respectively.

Figure 4:
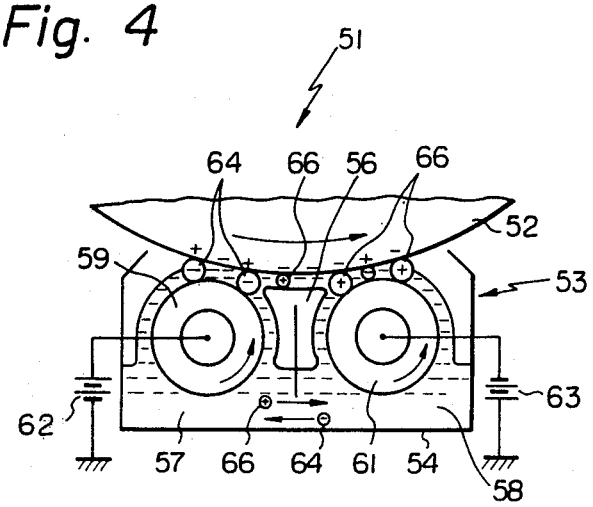
FIG. 4 is a schematic diagram of a fourth two color electrostatographic apparatus embodying the present invention.

FIG. 4 illustrates another electrostatic copying machine embodying the present invention which is generally designated as 51 and comprises a photoconductive drum 52 of the same general type as the drum 12. A bipolar electrostatic image is formed on the drum 52 in the same manner as the drum 12.

A combination red and black developing unit 53 comprises a developing tank 54 filled with a liquid dispersant. A partition 56 divides the developing tank 54 into a red developing section 57 and a black developing section 58. The lower part of the partition 56 is cut away to allow fluid communication between the sections 57 and 58. Although the upper edge of the partition 56 is very close to the drum 52, a small gap must be provided between the partition 56 and the drum 52 to prevent frictional abrasion.

Electrically conductive rollers 59 and 61 are provided in the sections 57 and 58 respectively and rotated counterclockwise at constant speed. A bias voltage source 62 applies a positive bias voltage to the roller 59 which has a magnitude smaller than the red electrostatic areas on the drum 52. A bias voltage source 63 applies a negative bias voltage to the roller 61 which has a magnitude smaller than the black electrostatic image areas on the drum 52. Red, negatively charged toner particles 64 are fed into the section 57 and suspended in the dispersant. Black, positively charged toner particles 66 are fed into the section 58 and suspended in the dispersant.

The bias voltage applied to the roller 59 by the source 62 provides the dual function of attracting the red toner particles 64 to the roller 59 and repelling the black toner particles 66 away from the roller 59 and section 57 into the section 58. Toner particles 66 which attempt to enter the section 57 from the section 58 above and below the partition 56 are repelled back into the section 58 due to the bias voltage on the roller 59.

The bias voltage applied by the source 63 to the roller 61 serves the dual function of attracting the black toner particles 66 to the roller 61 and repelling the red toner particles 64 into the section 57. However, in accordance with an important feature of the present invention, the bias voltage on the roller 61 also functions to repel the red toner particles 64 against the drum 52 and prevent degradation of the red toner image during development of the black toner image. Thus, the apparatus 51 produces excellent two color copies.

Due to the arrangement of FIG. 4, the developing tank 54 may be initially filled with a mixture of red and black toner particles 64 and 66 suspended in the dispersant. The bias voltage on the roller 59 will attract the red toner particles 64 to the roller 59 for application to the drum 52 and will repel the black toner particles 66 into the section 58 through the cutout below the partition 56. The bias voltage on the roller 61 will attract the black toner particles to the roller 61 for application to the drum 52 and repel the red toner particles 66 into the section 57 through the cutout under the partition 56.

In summary, it will be seen that the present invention provides a two color electrostatographic apparatus such as an electrostatic copying machine which overcomes the problems of the prior art and makes excellent two color copies of a quality which has been heretofore unobtainable. Various modifications will become possible for those skilled in the art after receiving the teachings of the present disclosure without departing from the scope thereof.

What is claimed is:

1. An electrostatographic apparatus including a member having a bipolar electrostatic image formed thereon, first developing means for applying toner of a first color and polarity to the member and second developing means for subsequently applying toner of a second color and polarity to the member, characterized by comprising:

bias voltage means for applying a bias voltage to at least one of the first and second developing means having a polarity opposite to the polarity of the toner which the respective first and second developing means applies to the member;

the bias voltage means applying a bias voltage of the first polarity to the second developing means and a bias voltage of the second polarity to the first developing means;

the first and second developing means in combination comprising a developing tank, a first roller, a second roller and a partition separating the first and second rollers in the developing tank, the bias voltage means applying the bias voltage of the first polarity to the second roller and applying the bias voltage of the second polarity to the first roller, the toner of the first color being dispersed in a liquid in which the first roller is immersed and the toner of the second color being dispersed in a liquid in which the second roller is immersed;

the partition being cut away at a lower portion thereof.

2. An apparatus as in claim 1, in which the bias voltage which the bias voltage means applies to the first developing means has a magnitude lower than a magnitude of a portion of the electrostatic image on the member which has the second polarity.

3. An apparatus as in claim 1, in which the bias voltage which the bias voltage means applies to the second developing means has a magnitude lower than a magnitude of a portion of the electrostatic image on the member which has the first polarity.

* * * * *